US008046979B2

(12) United States Patent
Ruzic et al.

(10) Patent No.: US 8,046,979 B2
(45) Date of Patent: Nov. 1, 2011

(54) PACKING MACHINE, IN PARTICULAR ENCOMPASSING A DEEP DRAWING MACHINE

(75) Inventors: Ivo Ruzic, Kempten (DE); Elmar Ehrmann, Bad Groenenbach (DE); Tieme Jam Slomp, Bad Groenenbach (DE)

(73) Assignee: Multivac Sepp Haggenmuller GmbH & Co. KG (DE)

( * ) Notice: Subject to any disclaimer, the term of this patent is extended or adjusted under 35 U.S.C. 154(b) by 132 days.

(21) Appl. No.: 12/227,023

(22) PCT Filed: May 4, 2007

(86) PCT No.: PCT/DE2007/000804

§ 371 (c)(1),
(2), (4) Date: Mar. 19, 2009

(87) PCT Pub. No.: WO2007/128281

PCT Pub. Date: Nov. 15, 2007

(65) Prior Publication Data

US 2009/0173049 A1 Jul. 9, 2009

(30) Foreign Application Priority Data

May 5, 2006 (DE) ..... 10 2006 021 345

(51) Int. Cl.
*B65B 47/04* (2006.01)

(52) U.S. Cl. ..... 53/561; 53/456

(58) Field of Classification Search ..... 53/452, 53/456, 425, 559, 561, 574, 267, 282, 389.1, 53/389.2; 422/1, 28, 33, 272, 305
See application file for complete search history.

(56) References Cited

U.S. PATENT DOCUMENTS

| | | | | | |
|---|---|---|---|---|---|
| 3,747,296 | A | * | 7/1973 | Zausner | 53/167 |
| 3,783,581 | A | * | 1/1974 | Pierce | 53/426 |
| 4,375,145 | A | * | 3/1983 | Mosse et al. | 53/425 |
| 4,707,334 | A | * | 11/1987 | Gerhard | 422/28 |
| 4,805,524 | A | * | 2/1989 | Deneuville et al. | 99/339 |
| 4,830,175 | A | * | 5/1989 | Durst et al. | 198/495 |
| 4,885,897 | A | * | 12/1989 | Gryouda et al. | 53/407 |
| 5,114,670 | A | * | 5/1992 | Duffey | 422/24 |

(Continued)

FOREIGN PATENT DOCUMENTS

DE 689 05 158 T2 6/1990

(Continued)

OTHER PUBLICATIONS

EPO machine translation, German publication DE 197 53 327, Christ, obtained Mar. 15, 2011.*

*Primary Examiner* — Paul Durand
(74) *Attorney, Agent, or Firm* — Brooks Kushman P.C.

(57) ABSTRACT

The present invention relates to a packing machine 1 for the packing of packed items, in particular encompassing a deep drawing machine 3 with a mold and/or a sealing device with a sealing tool. The packing machine is distinguished in that a cleaning device is provided for the mold and/or the sealing tool. Furthermore, the present invention also relates to a deep drawing machine and a sealing machine.

19 Claims, 4 Drawing Sheets

U.S. PATENT DOCUMENTS

| | | | | |
|---|---|---|---|---|
| 5,127,416 | A * | 7/1992 | Wakabayashi et al. | 134/104.1 |
| 5,178,841 | A * | 1/1993 | Vokins et al. | 422/298 |
| 5,534,222 | A * | 7/1996 | Kelbrick et al. | 422/33 |
| 5,587,127 | A * | 12/1996 | Carlson | 422/28 |
| 5,651,235 | A * | 7/1997 | Ashley et al. | 53/458 |
| 6,134,866 | A * | 10/2000 | Schoenewolff et al. | 53/561 |
| 6,179,017 | B1 | 1/2001 | Walter | |
| 6,622,457 | B2 * | 9/2003 | Kurth | 53/425 |
| 6,779,318 | B2 * | 8/2004 | Wang | 53/410 |
| 7,459,133 | B2 * | 12/2008 | Swank | 422/292 |
| 7,819,650 | B2 * | 10/2010 | Meskendahl et al. | 425/230 |
| 2002/0134051 | A1 * | 9/2002 | Kurth | 53/425 |
| 2005/0097863 | A1 * | 5/2005 | Taggart | 53/167 |
| 2005/0223679 | A1 * | 10/2005 | Gottlieb et al. | 53/425 |
| 2007/0114690 | A1 * | 5/2007 | Py et al. | 264/39 |
| 2010/0037984 | A1 * | 2/2010 | Hiroya et al. | 141/59 |
| 2010/0077701 | A1 * | 4/2010 | Ehmer | 53/425 |
| 2010/0107572 | A1 * | 5/2010 | Slomp et al. | 53/559 |

FOREIGN PATENT DOCUMENTS

| | | | |
|---|---|---|---|
| DE | 197 19 198 | A1 | 11/1998 |
| DE | 197 53 327 | A1 | 6/1999 |
| DE | 102 44 809 | B4 | 4/2004 |
| DE | 103 51 213 | A1 | 6/2005 |
| EP | 0 374 586 | | 6/1990 |
| EP | 1 403 187 | A1 | 3/2004 |

* cited by examiner

PACKING MACHINE, IN PARTICULAR ENCOMPASSING A DEEP DRAWING MACHINE

The invention relates to a packing machine for the packing of packed items, in particular encompassing a deep drawing machine and to a sealing machine.

BACKGROUND

Packing machines are frequently used in the packing of food products and must satisfy accordingly high hygiene requirements. In particular, machines of this type are regularly cleaned and disinfected in order reliably to prevent contamination of the packed items to be packed by residues or germs from the packing machine.

A basic element of the packing machine is a deep drawing or shell molding machine by means of which containers, which are subsequently filled with the packed items to be packed and sealed, are molded for example from film webs and a corresponding mold. Machines or devices of this type can consist of a plurality of parts: for example an upper and a lower shaping tool between which the film, which is generally drawn off from a roll, is drawn through in the transport direction and molded therewith to form a shell-shaped receptacle for the packed item to be packed, preferably in the clamping position.

For carrying out a deep drawing or shaping process of this type, the deep drawing or shaping device can encompass further elements, such as for example one or more heat sources, in order appropriately to preheat for the shaping process the film to be deep drawn, a lower and an upper matrix shaping the shell-shaped container to be molded, fluid line connections for applying reduced pressure and/or excess pressure to the shaping device, for example to bring the film as effectively as possible into abutment with a matrix, in particular in the corner regions, and optionally also one or more connections for applying the fluid, which is adapted to the packed item to be packed, to the molded container in order positively to influence the durability thereof and/or the visual appearance thereof when packed. If appropriate, the matrices can also be configured as insert elements which can be connected to corresponding sockets in order to be able to mold a plurality of differently molded packing containers, for example using a set consisting of an upper and a lower part of the deep drawing machine, by simple exchange of insert elements of this type.

Overall, a deep drawing or shaping device of this type has in the conventional manner a large number of edges, depressions, holes and the like in which impurities and in particular also residues from the packed item to be packed can become deposited.

Furthermore, a packing machine of this type can also encompass a sealing station or sealing device by means of which the packings filled with packed items can be sealed. For this purpose, the filled containers are conventionally covered with what is known as a cover film and connected to the packing securely and in an air-tight manner in the edge surrounding the packing troughs. Depending on the embodiment, this can be carried out in a manner which produces either a one-off fixed seal or else a seal which can be opened and resealed repeatedly. If appropriate, the packing can subsequently be isolated from a packing composite in a cutting station.

The sealing and cutting stations of this type also have to be cleaned again and again to avoid any contamination.

SUMMARY

The invention is based on the object of improving a packing machine, in particular encompassing a molding device and a sealing device corresponding to the type described at the outset.

Accordingly, a packing machine is provided in that a cleaning device is provided for at least one working unit. That has the advantage that the working unit in question, whether it be a shaping station for the forming of shell-shaped packing containers from a plastics material film to be molded accordingly, a sealing station for sealing shell-shaped, filled packing containers of this type with a cover film or an if appropriate subsequent cutting station with corresponding tools for the isolating of packings which may be joined together in a composite, can be cleaned in a purposeful manner.

The shell-shaped packing containers can be manufactured directly by a unit of the packing machine, in particular a molding device as described above; however, it is equally possible for them to be supplied to the packing machine preproduced in the form of what are known as tray sealers for filling and subsequent sealing and if appropriate following isolating.

In principle, the cleaning device which is provided in accordance with the invention can be associated with the packing machine as an upper unit. Conceivable for monitoring this cleaning device is both an independent monitoring unit for the cleaning device, optionally connected to a superordinate monitoring unit of the packing machine, and direct monitoring by a superordinate monitoring unit of this type.

However, for particular embodiments, it may well be advantageous if the cleaning device provided in accordance with the invention is configured as an independent, preferably even movable, unit with all accordingly associated central and peripheral components which will be described hereinafter in greater detail. However, in an embodiment modified in relation thereto, it can also be advantageous if the cleaning unit provided in accordance with the invention is directly associated with one of the working units to be cleaned, such as for example the shaping station, the sealing station and/or the cutting station. As a result of the fact that the working unit to be cleaned directly encompasses a cleaning device provided in accordance with the invention, said cleaning device can be optimally adapted both in its construction and with regard to the fluids required for the cleaning of the working unit in question, so that cleaning fluids which may be required for other working units to be cleaned and the necessary components therefor may be dispensed with in individual stations, or conversely there may be provided, in the case of working stations which are more costly to clean, additional means which may not be required in other working stations. This gives rise to for example the advantage that the packing machine can be modular in its construction, wherein it is entirely open which individual working units are to be provided.

On the other hand, a cleaning device configured as an independent unit could have the advantage that, in particular, supply containers for differing cleaning media have to be provided only once, and supply lines to the individual working stations to be cleaned each have to be linked up via corresponding connections only when required. An autonomous cleaning device of this type could if appropriate be used as the base cleaning device even for a plurality of packing machines provided.

It is particularly advantageous if a cleaning device is provided for the mold and/or for the sealing tool.

The term "mold" refers in the sense of the invention to all such means for the shaping of a film-like packing material to be deformed in accordance with the prior art described by way of example at the outset. In particular, the term is intended to include all elements which are configured and arranged within the deep drawing or shaping device and contribute to the shaping of the packing material which is for example to be molded into a shell. However, the term is also intended to include all units acting on or connected to the outside of the mold such as lifting and/or lowering tools, lines, connections, collection tanks and/or conduits, carrying and/or support elements, a housing which may be present and the like.

The term "sealing tool" refers in the sense of the invention to all those units which interact to seal the packings filled with the packed items: for example a bearing or receiving element, which may if appropriate consist of a plurality of parts, for the packing containers to be sealed, if present, a pressing plate, for example for pressing on a cover film, lifting and/or lowering and/or pivoting means for the generating of a relative movement between the aforementioned units, in order to allow opening or closing of the sealing tools, and also carrying and/or holding elements, a housing which may be present and the like.

The term "a cleaning device" refers in the sense of the invention to a device which is suitable for providing a cleaning fluid at the packing station to be cleaned, and in particular in the interior thereof, and for example consists of a central unit with correspondingly peripheral components.

The term "cleaning fluid" refers to both gaseous and liquid media, such as air to which excess pressure and/or reduced pressure are applied, optionally specific gases which are suitable for example for killing germs, water in pure form and/or in a form mixed with cleaning agent and/or disinfectant and/or sterilizing agent and the like.

In a particularly advantageous embodiment of the invention, the cleaning device encompasses a metering and/or mixing unit in order to add and/or to mix, from at least one cleaner and/or disinfectant and/or sterilizing agent, at least one cleaning fluid to the water available via the water connection.

The central unit of the cleaning device can for example encompass inter alia a monitoring unit for the individual components, which monitoring unit can in turn if appropriate be connected to one or more further monitoring units of the packing machine for the exchange of data, monitoring elements associated with various peripheral components such as valves and/or other actuating elements, sensors and the like, and also optionally an optical signal unit, for example in the form of a signal lamp, a simple display or else also a monitor and/or an acoustic signal unit, for example in the form of a horn or the like.

The peripheral components can encompass on the outer supply side for example a water connection, optionally one or more additive reservoirs, for example in the form of tanks, optionally exchangeable canisters or the like, connections for compressed air and for reduced pressure (vacuum) and if appropriate for specific cleaning gases on the supply side and the like. On the side of the cleaning device that supplies the components to be cleaned, examples would include connections and corresponding supply lines, optionally nozzles, further valves and/or other control units and if appropriate also sensors with corresponding connection means. Further features of the cleaning device will be described hereinafter.

Thus, provision is in particular made for the cleaning device to encompass a cleaning fluid supply line and/or a cleaning fluid discharge line for connection to the mold and/or for connection to the sealing tool. The device to be cleaned in each case can purposefully be supplied with cleaning fluid in the region to be cleaned therewith via the supply line which can if appropriate be configured separately for each individual cleaning fluid and/or for the two packing stations to be cleaned.

As a result of the provision of a cleaning fluid discharge line, the cleaning fluid issuing from the device in question during and after the process of cleaning said device can advantageously be removed in a collected manner without contamination of further elements of the packing machine, in particular of the actual device to be cleaned, and supplied to a collection and/or intermediate reservoir which may be present for any processing.

In order to be able purposely to clean the interior of the device to be cleaned with the cleaning fluid, it is furthermore advantageous if the cleaning device encompasses one, and preferably a plurality of, cleaning agent inlet opening or openings which open in the interior of the mold or in the interior of the sealing tool. It is particularly preferable for these cleaning agent inlet openings to be configured and arranged so as to allow the cleaning agent to flow out of critical regions in a particularly targeted manner with regard to contamination of the device in question, in particular can inject, such as for example in edges, corners, undercuts, depressions, holes, channels and other depressions, and most particularly in channels for further operating agents, such as vacuum channels for the removal by suction filtration of the air located in the mold, which, as a result of the suction effect prevailing therein, are most particularly endangered with regard to contamination and germination, but also in operating agent inlet openings, for example for air and/or fluid surrounding in the packed state the packed items to be packed, such as inert gas, a gas mixture having a specific oxygen content or the like.

A particularly high, local cleaning effect can be brought about by the configuration of nozzles in the region of the cleaning agent inlet opening. Cleaning agent inlet openings having a comparatively large cross section in relation thereto can in turn ideally be provided for the large-area or large-volume flushing of the device regions in question, in particular the interior thereof.

In order to be able to remove the cleaning agent supplied to the device in question from the device again, the cleaning device can also advantageously encompass a cleaning device outlet opening which can particularly preferably be arranged or configured in a lower portion of part of the device in question. In particular in the case of a mold consisting at least of two parts which are able to move relative to one another, both the mold part, which is conventionally arranged above the packing material to be deformed, and the part conventionally arranged below the packing film to be deformed can be provided with a corresponding discharge opening.

In a particularly preferred manner, the cleaning device can also have direct connections to an operating agent supply channel and/or to an operating agent disposal channel, so that said channels can also be directly flushed through.

In a further preferred manner, the cleaning device can also encompass a connection to a suction device, thus allowing at least most of the cleaning fluid which does not flow away independently to be removed by suction filtration from the region to be cleaned of the device in question, if appropriate also assisted by the supply of gas under excess pressure, for example compressed gas, so that after a sufficient through-flow period the device is cleansed not only of impurities to be removed but also of the residues of the cleaning fluid.

In order to be able to protect a heat source, in particular a heater, located in the device to be cleaned from the harmful influence caused by the cleaning fluid or impurities separated therefrom, a cover for a heat source of this type can also advantageously be provided. A protective device of this type is particularly advisable for electric heaters, as these are excessively susceptible to damage when acted on by cleaning agents, in particular with the application of elevated pressure.

It is therefore regarded as being particularly advantageous if a corresponding sealing region is provided between the cover or protective device and a complementary region, bordering the heater, of contact with the mold, so that the heater remains reliably protected even when cleaning fluid and elevated pressure are applied. In the case of an arrangement of a seal on a cover which can be removed again from the heater, the seal can if appropriate even be made of a material which is temperature-sensitive but produces a particularly good seal.

The operating or fastening of the heating cover can, depending on the embodiment, be manually actuatable or provided in automated form.

It is also proposed as being advantageous if the packing machine encompasses a cleaning device for the region of the packing machine that is configured below the transport plane of the packing film and between the sides of the packing machine. This allows all working units arranged in this region to be cleansed of impurities, regardless of whether these impurities originate from packed items to be packed, such as for example liquid or solid residues, or from packing material, for example in the form of portions or other, in some cases small-piece, residues.

The cleaning device itself can in turn encompass corresponding supply and/or disposal lines and supply and disposal openings in accordance with the features described hereinbefore, so that purposely determined regions can be sprayed and cleaned and extensive flushing or cleaning is possible.

In order to solve the problem posed, the present invention further encompasses a deep drawing or shell molding machine with a mold which is distinguished in that it is equipped with a cleaning device encompassing one or more above-described features based on a corresponding cleaning device.

In a further solution to the problem mentioned at the outset, the present invention also encompasses a sealing machine or sealing device which likewise encompasses a cleaning device again having one or more features of the above-described features focused on a sealing machine or sealing device.

BRIEF DESCRIPTION OF THE DRAWINGS

The invention will be described in greater detail based on the drawings and the description subsequently referring thereto. In the drawings.

DETAILED DESCRIPTION

Figure 1:
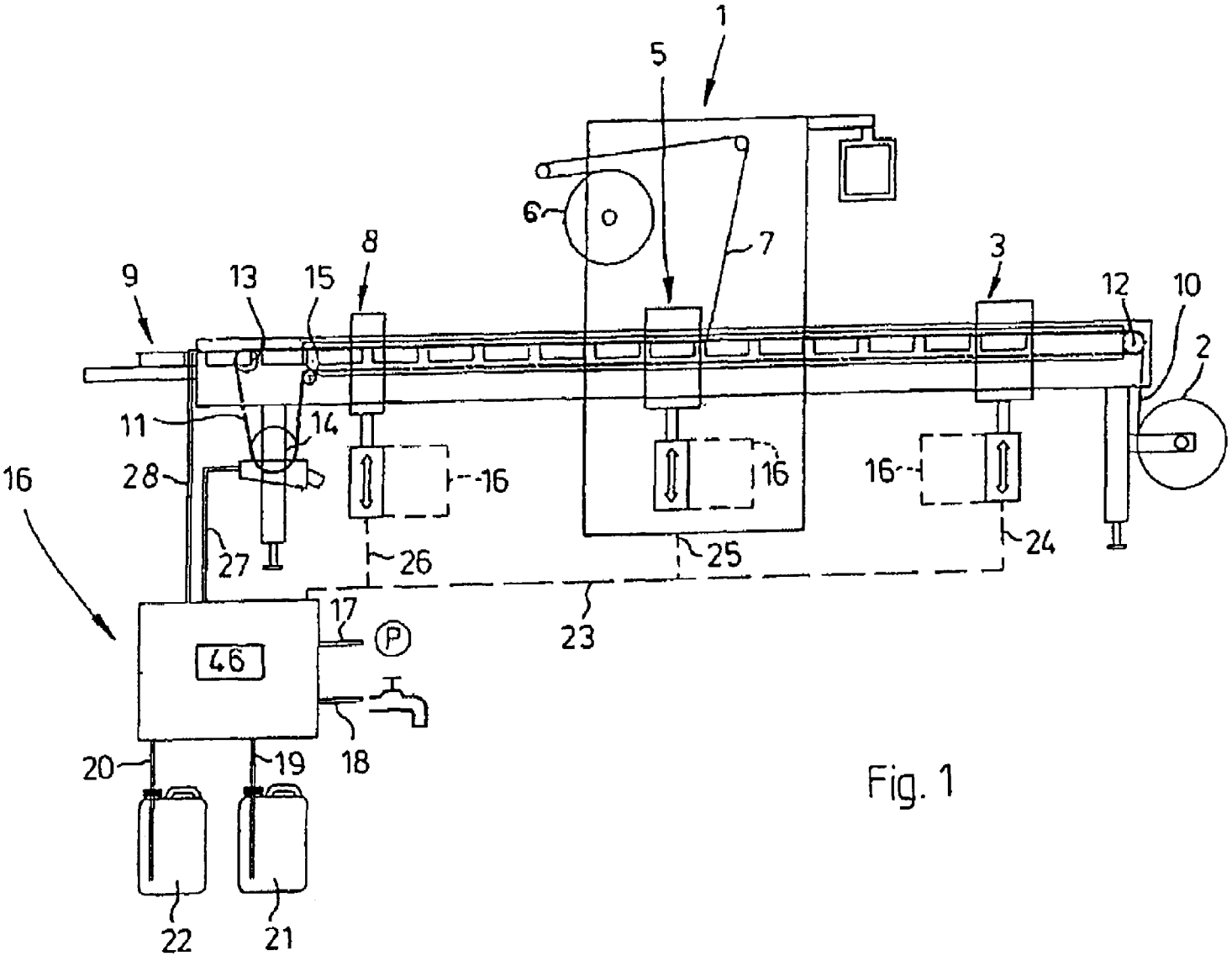
FIG. 1 is by way of example a schematic view of a packing machine according to the invention with a deep drawing machine and a sealing device.

The packing machine 1 is what is known as a rolling or deep drawing machine which molds packing troughs 4 in a molding station 3 from a film drawn off from a supply roll 2. The packing troughs 4 are filled and subsequently sealed in a sealing station 5 with the aid of a cover film 7 drawn off from a further supply roll 6.

In a cutting station 8, the individual packings are cut out from the overall composite and subsequently transferred to a discharge belt 9 for discharge from the packing machine. The film 10, and thus also the packing trough 4, is transported for example via a transport chain 11 which is configured so as to revolve via deflection rolls 12, 13, 14, 15.

Figure 2:
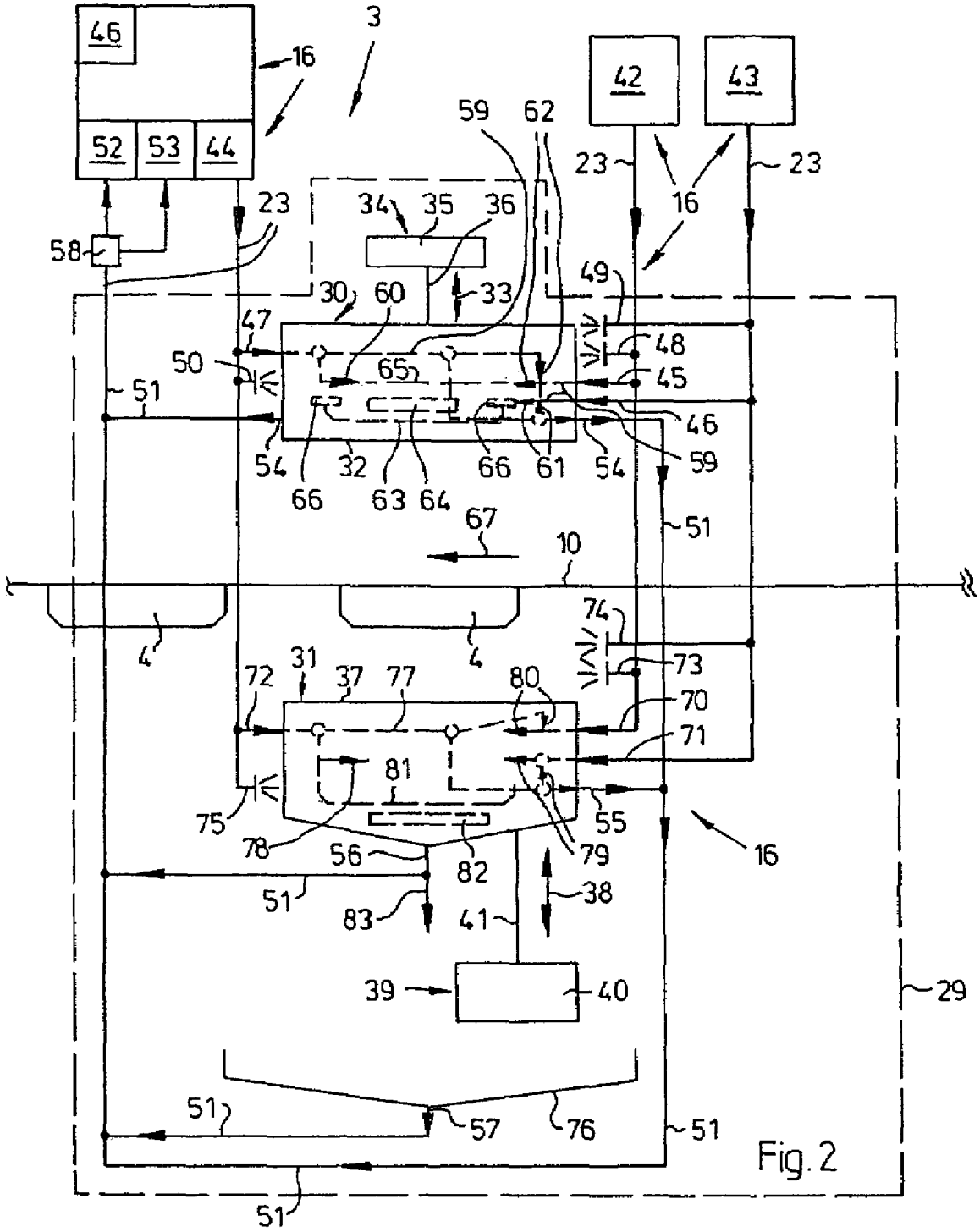
FIG. 2 is by way of example a schematic view of a deep drawing device.
Figure 3:
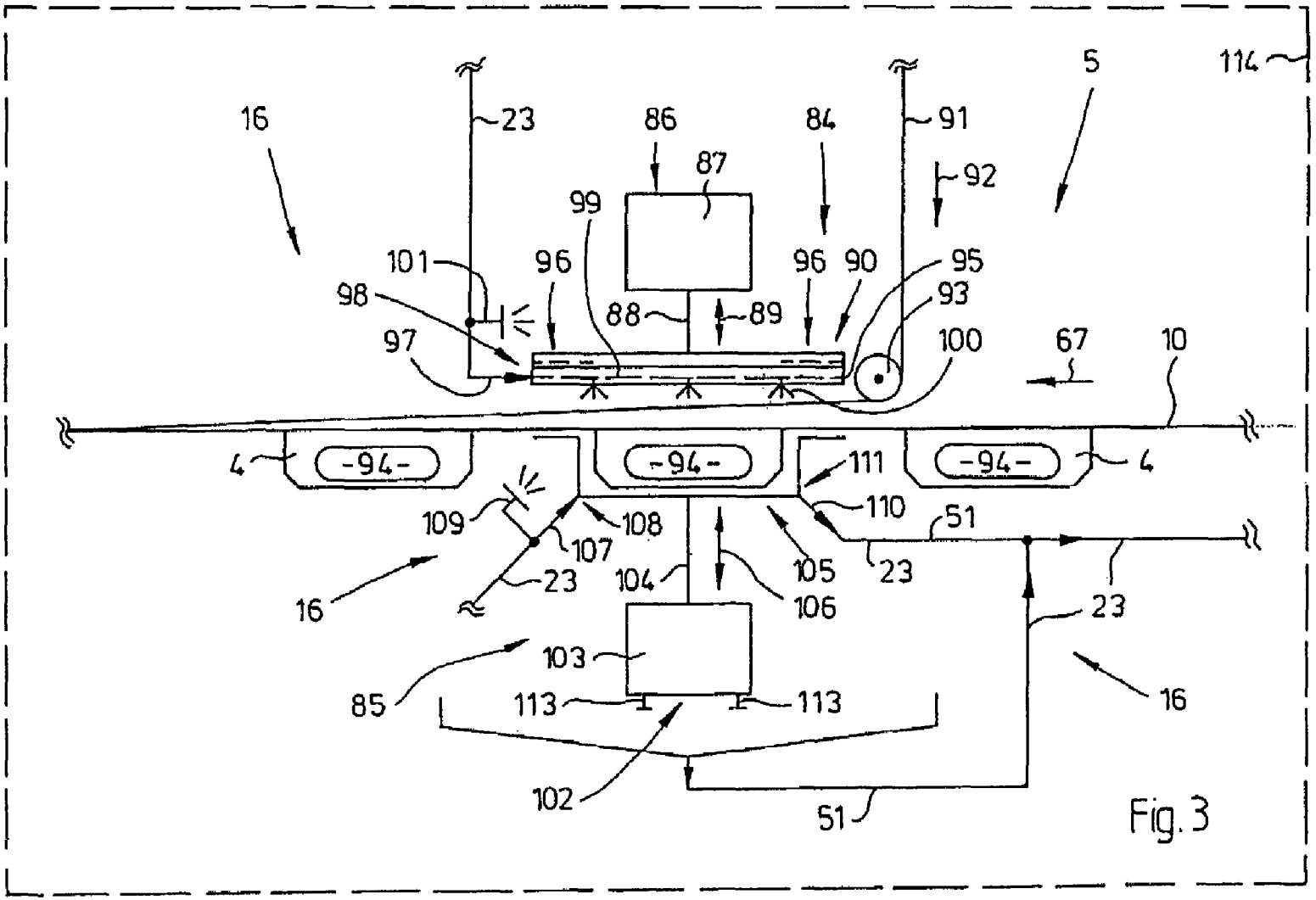
FIG. 3 is by way of example a schematic view of a sealing device.

According to the invention, a cleaning device 16 is then provided, in particular for cleaning the mold, illustrated in greater detail in FIG. 2, of the molding station 3 and also the sealing station 5 illustrated in greater detail in FIG. 3.

As shown in FIG. 1, the cleaning device 16 comprises, for the provision thereof with basic supplies, a compressed air connection 17, a water connection 18 and connections 19, 20, also illustrated by way of example, to preferably exchangeable supply tanks for cleaning agent 21, 22 representing, if appropriate, still further connection possibilities for supplying the devices 3 and 5 to be cleaned. The cleaning agent can in this case be for example cleaner, disinfectant or else sterilizing agent which can be supplied to the device or station to be cleaned, depending on the concentration, diluted by means of a metering and/or mixing unit 45 or else undiluted for carrying out the respective cleaning process of the device 3, 5 in question, monitored by the monitoring unit 46.

A line 23 is in this case illustrated symbolically and by way of example for a plurality of supply and/or discharge lines to individual devices of the packing machine, in particular to the molding station 3 and to the sealing station 5. The lines 24 and 25 represent symbolically the connections to the molding station 3 or to the sealing station 5. The lines 26, 27, 28 are further symbolic line connections to further components of the packing machine.

The exemplary, schematic view of FIG. 2 shows a deep drawing machine or molding station 3 encompassing an upper mold 30 and a lower mold 31 in a housing 29.

The upper mold 30 encompasses a basic element 32 which is in this case height-adjustable, for example along the two directions of the arrow 33 by means of a positioning device 34, in relation to the film 10 from which the packing troughs 4 are molded by the molding station 3.

The positioning device 34 can for example encompass a drive 35 and an actuating element 36, for example in the form of a motor and a corresponding spindle, in the form of cylinder and piston elements or the like.

Analogously, depending on the embodiment of the molding station 3, the same elements can be provided for the lower mold 31. Examples therefore include a basic element 37 which is position-adjustable, in particular height-adjustable, by means of a positioning device 39 along the two directions of the arrow 38 by means of the drive 40 and the actuating element 41 in relation to the film 10 to be deformed.

In this case, both on the upper and on the lower mold 30, 31, connections are connected to cleaning fluid supply lines 23, again so as to be representative of, if appropriate a plurality of, differently provided molds. These cleaning fluid supply lines 23 stand for example for supply lines both for liquid and for gaseous cleaning fluids. Thus, for example, there could be supplied to the device to be cleaned liquid fluids from a provision unit 42 and gaseous fluids from a provision unit 43 and if appropriate clean water via a provision unit 44.

The molding station 3 can be supplied, for example internally, with corresponding cleaning fluids via the connections 45, 46, 47; external supplying of the upper mold 30 is possible via the connections 48, 49, 50. For both regions, both internally and externally, the cleaning fluid can both be supplied to purposefully selected regions and applied over a large area, for example for precleaning and/or subsequent cleaning, but certainly also for the main clean.

In order to be able to lead the cleaning fluid away from the molding station 3 again, without additionally contaminating said molding station, also illustrated by way of example is a cleaning fluid discharge line 51 which opens in a container 52 (likewise illustrated by way of example) in order subsequently if appropriate to prepare and/or to dispose of the cleaning fluid. Cleaning agent outlet openings 54 are provided for the connection of the upper mold 30 to the cleaning fluid discharge line 51. Both liquid and gaseous cleaning fluids can be led away from the mold through said outlet openings, in a preferred manner to the intermediate stores 52 provided by way of example for if appropriate a plurality of, different, liquid cleaning agents or for the recollection of if appropriate reusable gaseous cleaning fluids to the intermediate store 53, again by way of example for, if appropriate, a plurality of different stores, controlled by a corresponding actuating element 58.

Within the upper mold 30, lines 59 are indicated by broken lines for distributing the cleaning fluids, in some cases with corresponding branches, to the individual inlet openings 60, 61 and 62, a plurality of which may if appropriate also be shown. Items 61 and 62 encompass both the inlet openings which are shown in broken lines in the form of arrows and also inlets, likewise shown symbolically in broken lines in the form of arrows, in corresponding connecting lines 59 for a respectively different exemplary cleaning fluid.

Shown by way of example for shaping the packing trough 4 in the film 10, likewise in the interior of the upper mold 30, is a matrix 63 within or else above which a heater 64 and thereabove a cover 65 are shown. Depending on its embodiment, the matrix 63 can likewise act as a cover to protect the heater. A seal 66, also shown by way of example, can be provided prior to infiltration of the cleaning fluid into the region of the heater, for example pressed against a correspondingly complementary contact region, bordering the heater region, within the upper mold 30.

In a corresponding way to the lower mold 31, further elements of the cleaning device 16 are shown associated by way of example below the film 10 moved in the transport direction 67. Said further elements encompass connections 70, 71, 72 for internally supplying the lower mold 31 and connections 73, 74 and 75 for external supply. For removing the cleaning fluid, the cleaning agent discharge openings 55, 56 and 57 are provided as connections to the cleaning fluid discharge line 51. In order to be able to remove also dripping cleaning liquid or impurities from the molding station 3, also illustrated by way of example is a collection tank 76 with a depressed region in which the cleaning fluid discharge opening 57 is arranged and connected to the cleaning fluid discharge line 51.

Lines 77 to inlet openings 78, 79 and 80 are shown within the lower mold 31 of the molding station 3 by way of example in accordance with the illustration and description pertaining to the upper mold 30. Also shown by way of example are a matrix 81, which is complementary to the upper matrix 63, for molding the packing trough 4 and also by way of example a heater 82. For the sake of clarity, further elements which may also be present for the molding station and/or the cleaning device 16 have not been illustrated. Merely for the sake of completeness, it should also be noted that also in the lower mold 31, for example, the matrix 81 can act as a cover for the heater 82, in a preferred manner also by way of a seal (not shown in the present document) preventing cleaning liquid from infiltrating toward the heater.

In a particularly advantageous manner, the cleaning fluid discharge opening 56 is formed at a particularly low point of the molding station, in this case by way of example at a downwardly converging region of the lower mold, at the lowest point thereof. In this case too, the guidance of corresponding channels, holes or lines within the mold has been dispensed with for the sake of clarity. Merely one discharge 83 is shown oriented toward the collection tank 74 symbolically for if appropriate further discharges, in order to be able to collect any cleaning liquid issuing therefrom.

In addition to the inner or outer possibility for cleaning by way of the cleaning device 16, cleaning and/or backflushing is also possible, if necessary, for the respective supply lines 23, in particular by way of the connections of said cleaning device via the lines 59 and 77.

FIG. 3 shows a sealing station 5 with an upper sealing tool 84 and a lower sealing tool 85.

The upper sealing tool 84 encompasses, in a manner corresponding to the molding station 3, a positioning device 86 which consists of a drive 87 and an actuating element 88 and can move the tool 90 up and down in accordance with the two directions of the arrow 89 for sealing the packing trough with a cover film 91. The arrow 92 indicates the direction of movement of the cover film 91 which deflects via a deflection roll 93 via the film 10 and the packing troughs formed and filled therein.

The tool 90 provided for sealing encompasses in this case, illustrated by way of example, a plate 95 for pressing the cover film 91 against the film 10, thus allowing sealing of the packing troughs 4 which are formed therein and filled with packed items. Indicated for heating the plate 95, such as may be necessary, is for example a heater 96 which is formed at least in the region in which the cover film is superimposed for sealing the packing troughs with the lower film 10.

A respective line 23 is illustrated as a connection to the cleaning device 16 for supplying the sealing station with cleaning fluid, in this case too by way of example for a plurality of lines which may be provided, both for the upper and for the lower mold 84, 85. This line 23 has for the upper sealing tool 84 a connection 97 to an inlet opening 98 and an inner line 99 fed therewith and also outlet openings 100 which are connected to and preferably arranged distributed in a planar manner on the underside of the plate 95.

An outlet 101 is illustrated by way of example for externally supplying the upper sealing tool 84 with cleaning fluid. Said outlet can for example be in the form of a spray nozzle, a surge opening or the like, in order either to spray off highly purposely determined regions or else simply just to flush off even relatively large areas, and is thus representative of correspondingly provided cleaning elements, such as is for that matter also the case for the molding station described with reference to FIG. 2.

A positioning device 102 with a drive 103 and actuating element 104 is likewise provided for the lower sealing tool 85 in order to be able to move the tool 105 up and down in accordance with the two directions of the arrow 106 for receiving or re-releasing a packing trough 4.

In order also to be able accordingly to clean the lower, preferably trough-shaped tool 105, a connection 107 to an inlet opening 108 is shown in this case too for supplying the interior with cleaning fluid. A connection 109 is again illustrated so as to be representative, as for the upper sealing tool, of the external supplying of the lower sealing tool.

A connection 110 of the cleaning fluid discharge line 51 is connected to a cleaning fluid outlet opening 111, again preferably at a lowest possible point, in particular the lowest point within the sealing tool, so that cleaning liquid introduced without additional assistance can flow out from the tool at this location. In order to be able to collect externally applied cleaning liquid, a collection tank 112, which is in turn connected to the cleaning fluid discharge line 51, is also shown.

Carrying elements 113 and a housing 114 are illustrated by way of example so as to represent still further elements, in particular mechanical construction elements of this sealing station.

Figure 4:
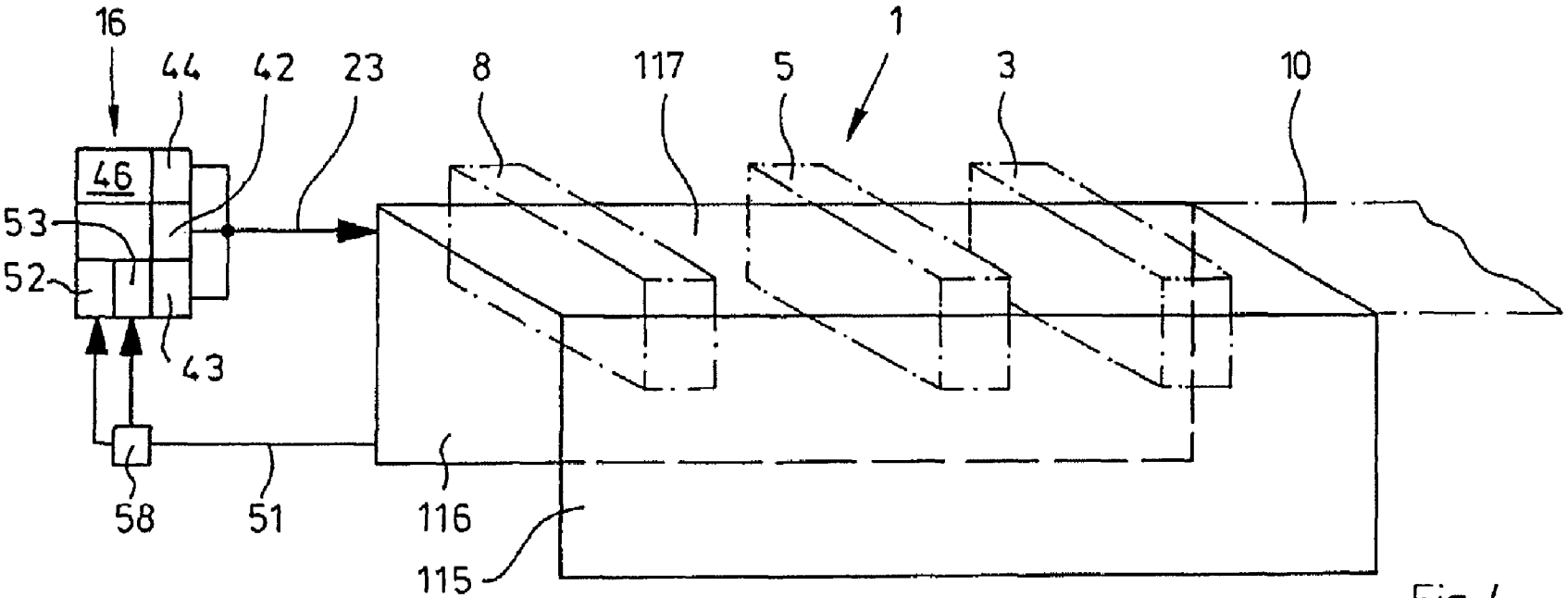
FIG. 4 is a schematic perspective view onto a packing machine provided with a cleaning device.

Finally, FIG. 4 is a schematic perspective view of a packing machine 1 and a cleaning unit 16 associated therewith for cleaning the region of the packing machine that is formed below the film 10, which is provided for forming the shell-shaped packing troughs 4, and between the side walls 115 and 116 associated with the packing machine 1. Item 117 denotes the film plane in which the film 10, if provided, is advanced for forming the packing troughs, for filling, for sealing and for final isolating. Indicated by broken lines for this purpose, merely by way of example, are a working station 3 as the shaping station, subsequently a sealing station 5 and, following that, a cutting station 8. However, depending on the application or embodiment, it is also quite possible for other compositions of the individual working stations to be provided. For example, the shaping station could also be dispensed with in the filling of what are known as tray sealers. The illustration in FIG. 4 is accordingly just representative of a large number of different possible embodiments of a corresponding packing machine with a cleaning unit 16 provided in accordance with the invention.

LIST OF REFERENCE NUMERALS

1 Packing machine
2 Supply roll
3 Molding station
4 Packing trough
5 Sealing station
6 Supply roll
7 Cover film
8 Cutting station
9 Discharge belt
10 Film
11 Transport chain
12 Deflection roll
13 Deflection roll
14 Deflection roll
15 Deflection roll
16 Cleaning device
17 Compressed air connection
18 Water connection
19 Connection
20 Connection
21 Disinfection supply container
22 Cleaning container
23 Line
24 Line
25 Line
26 Line
27 Line
28 Line
29 Housing
30 Upper mold
31 Lower mold
32 Basic element
33 Arrow
34 Positioning device
35 Drive
36 Actuating element
37 Basic element
38 Arrow
39 Positioning device
40 Drive
41 Actuating element
42 Provision unit
43 Provision unit
44 Provision unit
45 Metering and/or mixing unit
46 Monitoring unit
47 Connection
48 Connection
49 Connection
50 Connection
51 Cleaning fluid discharge line
52 Container
53 Container
54 Cleaning agent discharge opening
55 Cleaning agent discharge opening
56 Cleaning agent discharge opening
57 Cleaning agent discharge opening
58 Actuating element
59 Line
60 Inlet opening
61 Inlet opening
62 Inlet opening
63 Matrix
64 Heater
65 Cover
66 Seal
67 Transport direction
68 Connection
69 Connection
70 Connection
71 Connection
72 Connection
73 Connection
74 Connection
75 Connection
76 Collection tank
77 Line
78 Inlet opening
79 Inlet opening
80 Inlet opening
81 Matrix
82 Heater
83 Discharge
84 Upper sealing tool
85 Lower sealing tool
86 Positioning device
87 Drive
88 Actuating element
89 Arrow
90 Tool
91 Cover film
92 Conveyance direction
93 Deflection roll
94 Packed item
95 Plate
96 Heater
97 Connection
98 Inlet opening
99 Line
100 Outlet opening
101 Outlet
102 Positioning device
103 Drive

104 Actuating element
105 Tool
106 Arrow
107 Connection
108 Inlet
109 Connection
110 Connection
111 Outlet opening
112 Collection tank
113 Carrying element
114 Housing
115 Side wall
116 Side wall
117 Film plane

What is claimed is:

1. A packing machine for the packing of packed items in a trough-shaped packing made of a plastics material film, comprising:

a working unit comprising at least one of a molding device with a mold, a sealing device with a sealing tool, and a cutting station with a cutting tool for separating a composite of a plurality of packings, wherein a cleaning device is provided for the working unit, wherein the cleaning device is provided for one of the mold, the seal tool, and the cutting tool, and wherein a discharge opening for cleaning fluid is formed in a lower part of at least one of the mold, the sealing tool, and the cutting tool.

2. The packing machine as claimed in claim 1, wherein the cleaning device is configured as an independent unit.

3. The packing machine as claimed in claim 1, wherein the cleaning device is encompassed in a working unit.

4. The packing machine as claimed in claim 1, wherein the cleaning device encompasses at least one of a cleaning fluid supply line, and a cleaning fluid discharge line for connection to one of the mold, the sealing tool, and the cutting tool.

5. The packing machine as claimed in claim 1, wherein the cleaning device encompasses a cleaning agent inlet opening which opens in the interior of at least one of the mold, and the sealing tool.

6. The packing machine as claimed in claim 5 wherein the cleaning device encompasses a cleaning agent outlet opening which leads out at least one of the mold, and the sealing tool.

7. The packing machine as claimed in claim 1, wherein the cleaning device has a connection to at least one of an operating agent supply channel, an operating agent disposal channel of the mold, and the sealing tool.

8. The packing machine as claimed in claim 7, wherein the cleaning device encompasses a connection to a suction device.

9. The packing machine as claimed in claim 1, further comprising a heater for at least one of the mold and the sealing tool.

10. The packing machine as claimed in claim 9, wherein a cover is provided for the heater.

11. The packing machine as claimed in claim 10, wherein a seal is provided between the cover and a complementary region, bordering the heater, of a contact face for the heater.

12. The packing machine as claimed in claim 1, wherein the cleaning device is provided for the region of the packing machine that is configured below the transport plane of packing film and between side walls of the packing machine.

13. A packing machine for the packing of packed items in a trough-shaped packing made of a plastics material film, the packaging machine comprising:

a working unit comprising a molding device with a mold, a sealing device with a sealing tool, and a cutting station for separating a composite of a plurality of packings; and a cleaning device in communication with at least one of the molding device and the sealing device, wherein the cleaning device comprises a cleaning agent inlet opening which opens in the interior of at least one of the mold and the sealing tool, wherein at least one of the mold or the sealing tool has a lower part having a cleaning fluid discharge opening formed therein.

14. The packing machine as claimed in claim 13, wherein the cleaning device comprises at least one of a cleaning fluid supply line, and a cleaning fluid discharge line connected to one of the mold and the sealing tool.

15. The packing machine as claimed in claim 14 wherein the cleaning device comprises a cleaning agent outlet opening which leads out at least one of the mold and the sealing tool.

16. The packing machine as claimed in claim 15, wherein the cleaning agent inlet opening and the cleaning agent outlet opening are in fluid communication with the cleaning device.

17. The packing machine as claimed in claim 15 wherein distribution lines extend between the cleaning agent inlet opening and the cleaning agent outlet opening to provide fluid communication between the cleaning agent inlet opening and the cleaning agent outlet opening.

18. A molding device for the molding of trough-shaped packings made of a plastics material film for a packing machine for the packing of packed items, comprising:

a mold, and a cleaning device provided for and in fluid communication with the interior of the mold, the mold having a lower part having a cleaning fluid discharge opening formed therein.

19. A sealing device for the sealing of trough-shaped packings made of a plastics material film for a packing machine for the packing of packed items comprising:

a sealing tool and a cleaning device for and in fluid communication with the sealing tool, the sealing tool having a lower part having a cleaning fluid discharge opening formed therein.

* * * * *